US010006624B2

(12) United States Patent
Austin et al.

(10) Patent No.: US 10,006,624 B2
(45) Date of Patent: Jun. 26, 2018

(54) ARTIFICIAL EVERGREEN TREE

(71) Applicant: General Foam Plastics Corporation, Virginia Beach, VA (US)

(72) Inventors: Eva Austin, Norfolk, VA (US); Ashley Kinnaird, Virginia Beach, VA (US); Carol McMurtrie, Virginia Beach, VA (US); Gwen Owens, Virginia Beach, VA (US); Laura Luth, Norfolk, VA (US); Gary Lawson, Suffolk, VA (US); Margaret Heuisler, Chesapeake, VA (US); Katherine Stapleton, Virginia Beach, VA (US); Sanford Caprow, Virginia Beach, VA (US); Jack Hall, Charleston, VA (US); Chris Lemmon, Richmond, VA (US)

(73) Assignee: General Foam Plastics Corporation, Virginia Beach, VA (US)

( * ) Notice: Subject to any disclaimer, the term of this patent is extended or adjusted under 35 U.S.C. 154(b) by 88 days.

(21) Appl. No.: 15/174,310

(22) Filed: Jun. 6, 2016

(65) Prior Publication Data

US 2016/0360914 A1 Dec. 15, 2016

Related U.S. Application Data

(60) Provisional application No. 62/174,583, filed on Jun. 12, 2015, provisional application No. 62/222,153,
(Continued)

(51) Int. Cl.
*A47G 33/08* (2006.01)
*F21V 33/00* (2006.01)
(Continued)

(52) U.S. Cl.
CPC ..... *F21V 33/0028* (2013.01); *A41G 1/007* (2013.01); *A47G 33/06* (2013.01); *A47G 2033/0827* (2013.01)

(58) Field of Classification Search
CPC ..... A47G 33/06; A41G 1/007
See application file for complete search history.

(56) References Cited

U.S. PATENT DOCUMENTS 3,970,834 A * 7/1976 Smith ..... A47G 33/06 248/435
2008/0291662 A1* 11/2008 Barbieri ..... A47G 33/06 362/123
(Continued)

*Primary Examiner* — Anh Mai
*Assistant Examiner* — Zachary J Snyder
(74) *Attorney, Agent, or Firm* — Ice Miller LLP

(57) ABSTRACT

An artificial evergreen tree is provided having a plurality of branch rings. Each branch ring includes a plurality of nests. A tree branch base is rotatably coupled to each of the plurality of nests and has a branch assembly coupled thereto. The branch ring includes bottom segment having a bottom segment electrical contact. The branch ring includes a top segment having a top segment electrical contact that is in electrical communication with the bottom segment electrical contact. The plurality of nests is positioned between the bottom segment and the top segment. The top segment of a first branch ring is configured to couple to the bottom segment of a second branch ring so that the top segment electrical contact of the first branch ring and the bottom segment electrical contact of the second branch ring are coupled in electrical communication.

21 Claims, 18 Drawing Sheets

Related U.S. Application Data filed on Sep. 22, 2015, provisional application No. 62/261,619, filed on Dec. 1, 2015.

(51) Int. Cl.
*A41G 1/00* (2006.01)
*A47G 33/06* (2006.01)

(56) References Cited

U.S. PATENT DOCUMENTS

2010/0196628 A1* 8/2010 Shooley ..... A47G 33/06
428/19
2015/0070878 A1* 3/2015 Yu ..... F21V 23/06
362/123

* cited by examiner

ARTIFICIAL EVERGREEN TREE

CROSS-REFERENCE TO RELATED APPLICATIONS

The present application is a non-provisional of, and claims priority to, U.S. Provisional Patent Application Ser. No. 62/174,583, filed Jun. 12, 2015, and titled "ARTIFICIAL EVERGREEN TREE," U.S. Provisional Patent Application Ser. No. 62/222,153, filed Sep. 22, 2015, and titled "ARTIFICIAL EVERGREEN TREE," and U.S. Provisional Patent Application Ser. No. 62/261,619, filed Dec. 1, 2015, and titled "ARTIFICIAL EVERGREEN TREE." The disclosure of each of the forgoing applications is hereby incorporated by reference.

BACKGROUND

Consumers choose artificial evergreen trees for their convenience. Artificial evergreen trees have no needles that shed, require no watering, and eliminate the need to transport an evergreen tree from a tree farm or other location to the consumer's house, and then to dispose of the evergreen tree, for example, at the end of the Christmas season. However, artificial evergreen trees can leave much to be desired. Artificial evergreen trees can be heavy, and difficult to assemble and disassemble. Artificial evergreen trees can be difficult to store, and difficult to restore to their original shape after being in storage.

For the foregoing reasons, it is desired to provide improved artificial evergreen trees.

SUMMARY

In one aspect, an artificial evergreen tree is provided. The artificial evergreen tree includes a first branch ring having a plurality of first nests. Each of a plurality of first tree branch bases is rotatably coupled to a respective one of the plurality of first nests and has one of a plurality of first branch assemblies coupled thereto. The first branch ring also includes a first bottom segment having a first bottom segment electrical contact. The first branch ring also includes a first top segment having a first top segment electrical contact that is in electrical communication with the first bottom segment electrical contact. The plurality of first nests is positioned between the first bottom segment and the first top segment. The artificial evergreen tree also includes a second branch ring having a plurality of second nests. Each of a plurality of second tree branch bases is rotatably coupled to a respective one of the plurality of second nests and has one of a plurality of second branch assemblies coupled thereto. The second branch ring also includes a second bottom segment having a second bottom segment electrical contact. The second branch ring also includes a second top segment having a second top segment electrical contact that is in electrical communication with the second bottom segment electrical contact. The plurality of second nests is positioned between the second bottom segment and the second top segment. The first top segment of a first branch ring is configured to couple to the second bottom segment of a second branch ring so that the first top segment electrical contact of the first branch ring and the second bottom segment electrical contact of the second branch ring are coupled in electrical communication.

In one aspect, each of the plurality of first branch assemblies and the plurality of second branch assemblies also includes at least one light that is electrically coupled to the respective first branch ring or second branch ring.

In one aspect, the at least one light of one of the plurality of first branch assemblies and the plurality of second branch assemblies is replaceable without replacing the at least one light of another of the plurality of first branch assemblies and the plurality of second branch assemblies.

In one aspect, an insulator is positioned over the first top segment electrical contact of the first branch ring.

In one aspect, the second bottom segment includes a root defining a shoulder. The root and the shoulder stabilize the artificial evergreen tree when the first top segment of the first branch ring is coupled to the second bottom segment of the second branch ring.

In one aspect, each of the first branch ring and the second branch ring includes a light ring having at least one of upward facing and downward facing lights. The light ring is electrically coupled to the respective first top segment electrical contact and first bottom segment electrical contact or second top segment electrical contact and second bottom segment electrical contact.

In one aspect, a topper is received in the second top segment of the second branch ring so that the topper electrically couples to the second branch ring.

In one aspect, a stand receives the first bottom segment of the second branch ring.

In one aspect, any number of first branch rings and second branch rings may be coupled to the stand.

In one aspect, the stand is electrically coupled to the first branch ring and the second branch ring.

In one aspect, an artificial evergreen tree is provided. The artificial evergreen tree includes a first branch ring having a plurality of first nests. Each of a plurality of first tree branch bases is rotatably coupled to a respective one of the plurality of first nests and has one of a plurality of first branch assemblies coupled thereto. The first branch ring includes a first bottom segment having a first bottom segment thread. The first branch ring includes a first top segment having a first top segment thread. The plurality of first nests is positioned between the first bottom segment and the first top segment. The artificial evergreen tree also includes a second branch ring having a plurality of second nests. Each of a plurality of second tree branch bases is rotatably coupled to a respective one of the plurality of second nests and has one of a plurality of second branch assemblies coupled thereto. The second branch ring includes a second bottom segment having a second bottom segment thread. The second branch ring includes a second top segment comprising a second top segment thread. The plurality of second nests is positioned between the second bottom segment and the second top segment. The first top segment of a first branch ring is configured to couple to the second bottom segment of a second branch ring so that the first top segment thread of the first branch ring and the second bottom segment thread of the second branch ring are coupled.

In one aspect, the first top segment thread of the first branch ring and the second bottom segment thread of the second branch ring stabilize the artificial evergreen tree when the first top segment of the first branch ring is coupled to the second bottom segment of the second branch ring.

In one aspect, the second bottom segment includes a root defining a shoulder. The root and the shoulder stabilize the artificial evergreen tree when the first top segment of the first branch ring is coupled to the second bottom segment of the second branch ring.

In one aspect, the first branch ring and the second branch ring are electrically coupled when the first top segment of the first branch ring is coupled to the second bottom segment of the second branch ring.

In one aspect, each of the first branch ring and the second branch ring includes a light ring having at least one of upward facing and downward facing lights.

In one aspect, each of the plurality of first branch assemblies and the plurality of second branch assemblies includes at least one light that is electrically coupled to the respective first branch ring or second branch ring.

In one aspect, the at least one light of one of the plurality of first branch assemblies and the plurality of second branch assemblies is replaceable without replacing the at least one light of another of the plurality of first branch assemblies and the plurality of second branch assemblies.

In one aspect, a stand to receive the first bottom segment of the second branch ring.

In one aspect, any number of first branch rings and second branch rings may be coupled to the stand.

In one aspect, the stand is electrically coupled to the first branch ring and the second branch ring.

BRIEF DESCRIPTION OF THE DRAWINGS

The features and advantages of this disclosure, and the manner of attaining them, will be more apparent and better understood by reference to the following descriptions of the disclosed methods and systems, taken in conjunction with the accompanying drawings, wherein.

DESCRIPTION

Figure 1:
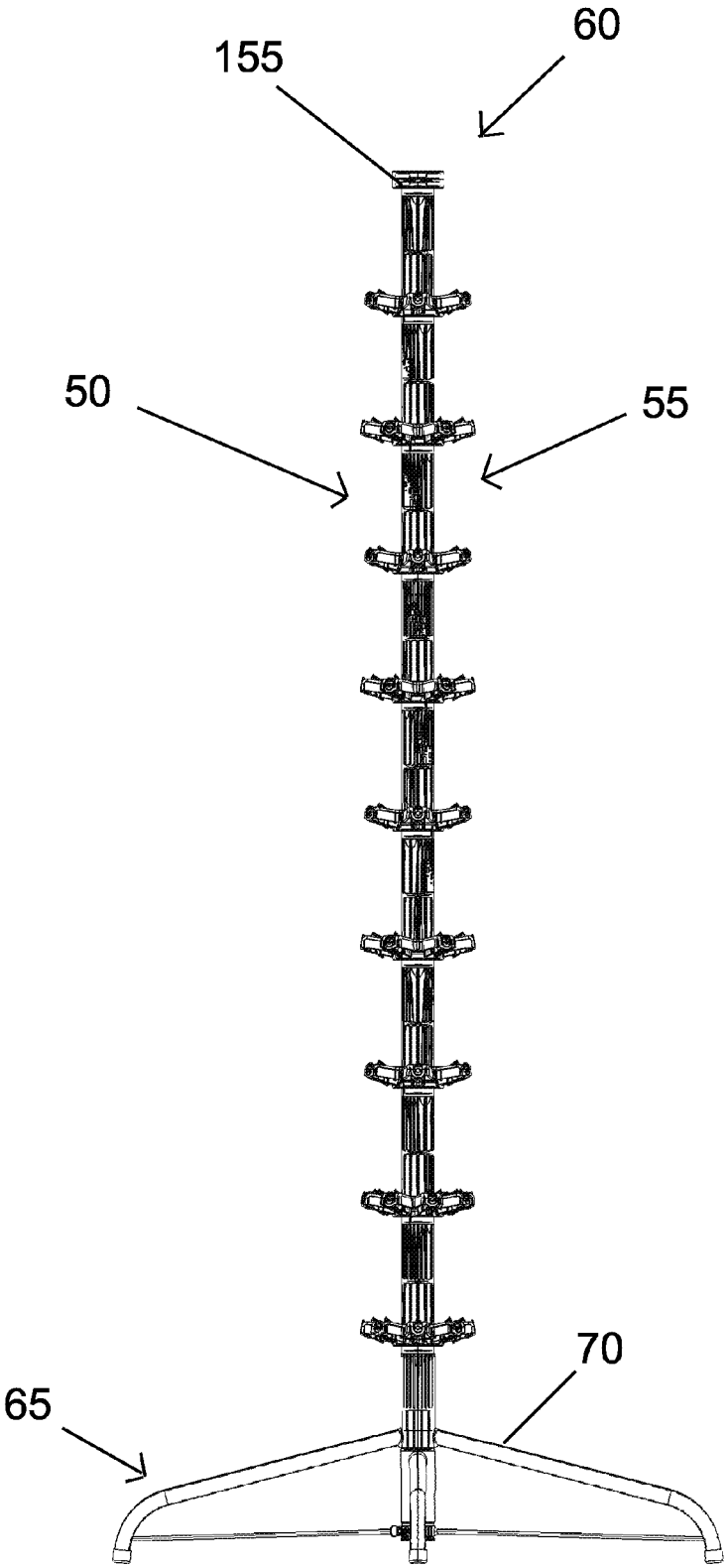
FIG. 1 illustrates a front view of an artificial evergreen tree assembly in accordance with an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows an artificial evergreen tree pole assembly 50, according to at least one embodiment of the present disclosure. The artificial evergreen tree pole assembly 50 includes a center pole 55 having an upper end 60 and a lower end 65. The lower end 65 terminates in a stand 70, which retains the center pole 55 in a vertical position. The upper end 60 terminates in a topper 155.

Figure 2:
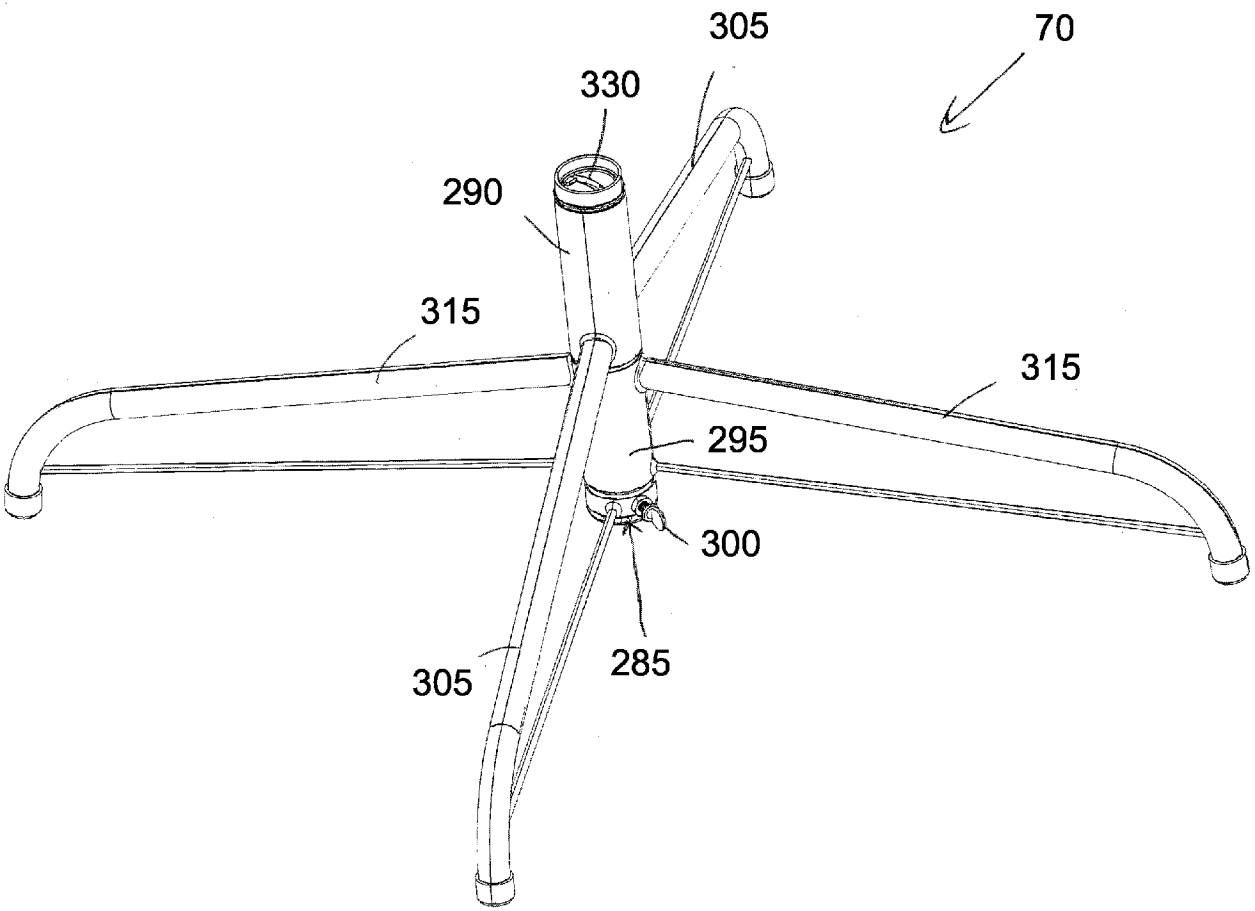
FIG. 2 is a top perspective view of a stand in accordance with an embodiment.
Figure 3:
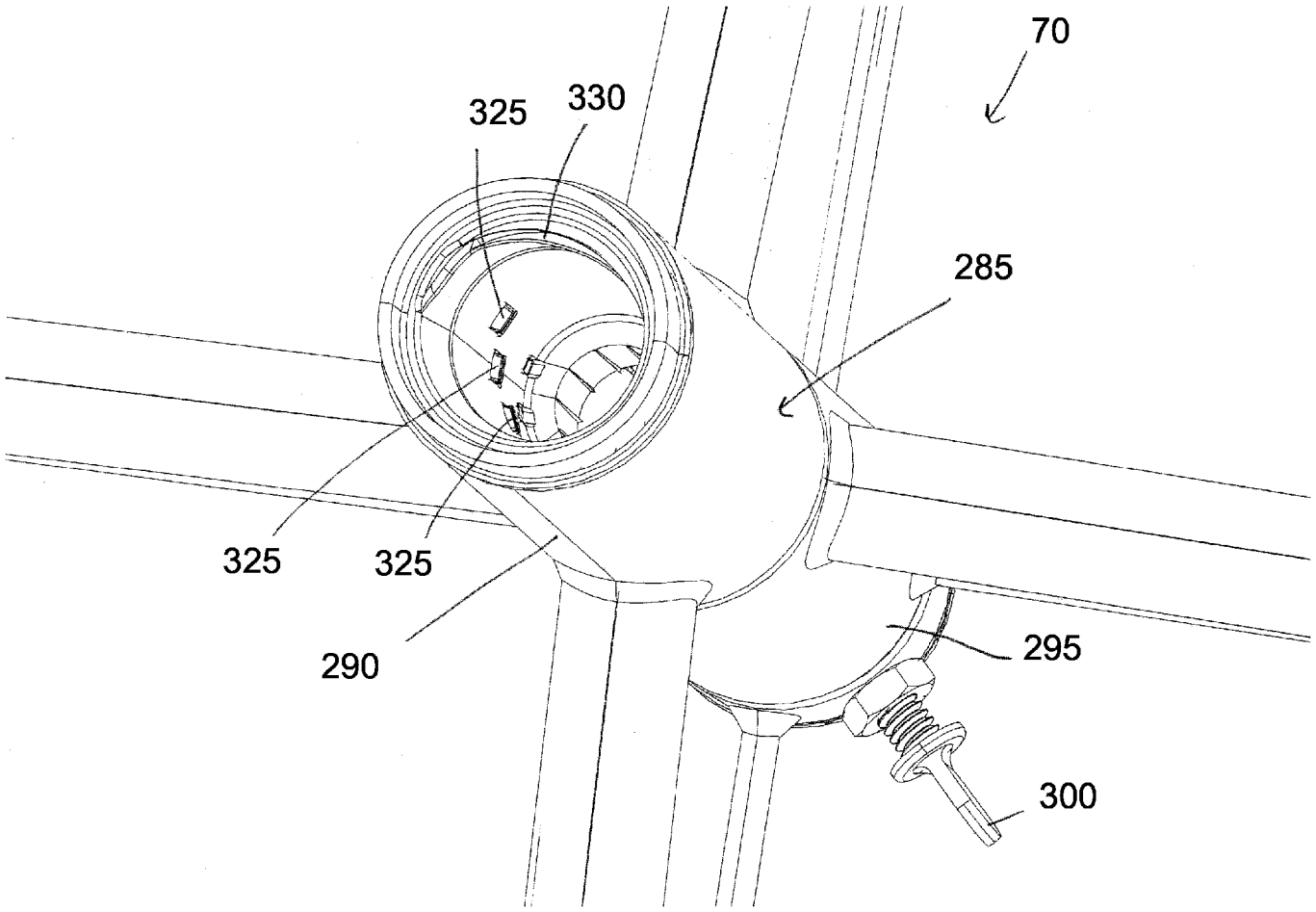
FIG. 3 is a top perspective view of a stand in accordance with an embodiment.

FIGS. 2-3 illustrate the stand 70. The stand 70 includes a center post 285. The center post 285 includes an upper post 290 and a lower post 295. A bottom portion (not shown) of the upper post 290 rests within the lower post 295. The upper post 290 is configured to rotate with respect to the lower post 295. A fastener 300 is configured to lock the upper post 290 with respect to the lower post 295. In particular, the fastener 300 is threaded through an opening in the lower post 295 and secures the bottom portion of the upper post 290 within the lower post 295. A pair of upper legs 305 extends radially outward from the upper post 290. The upper legs 305 are curved so that ends of each leg are in contact with the ground when the stand 70 is in use. A pair of lower legs 315 extends radially outward from the lower post 295. The lower legs 315 are positioned below the upper legs 305 in relation to the center post 285. The lower legs 315 are likewise curved so that ends of each leg are in contact with the ground when the stand 70 is in use.

During operation, the fastener 300 is manipulated so that the fastener 300 disengages the upper post 290. In this position, the upper post 290 rotates freely with respect to the lower post 295 so that the upper legs 305 and the lower legs 315 may be rotated to the operational. In at least one embodiment, in an operational position, the upper legs 305 are oriented approximately perpendicular to the lower legs 315, as shown in FIG. 2. Following a review of the present disclosure, it would be understood by one of skill in the art, that the upper legs 305 may be positioned at any angle to the lower legs 315 so long as the stand 70 is securely positioned upright. Once the operational position is achieved, the fastener 300 may be manipulated to apply pressure to the upper post 290, thereby securing the upper post 290 within the lower post 295 so that the posts 290, 295 and legs 305, 315 may not rotate with respect to one another.

After use, the fastener 300 is manipulated so that the fastener 300 disengages the upper post 290. In this position, the upper post 290 rotates freely with respect to the lower post 295 so that the upper legs 305 and the lower legs 315 may be rotated to a storage position. In at least one embodiment, in the storage position, the upper legs 305 rest adjacent to the lower legs 315. Once the storage position is achieved, the fastener 300 may be manipulated to apply pressure to the upper post 290, thereby securing the upper post 290 within the lower post 295 so that the posts 290, 295 and legs 305, 315 may not rotate with respect to one another.

In at least one embodiment, the center post 285 includes a plurality of electrical connections 325. In at least one embodiment, the plurality of electrical connections 325 is provided in the upper post 290. In at least one embodiment, the plurality of electrical connections 325 is positioned on an interior surface of the center post 285. Additionally, a thread 330 may be provided on the interior surface of the center post 285. The center post 285 is constructed and arranged to receive a branch ring 115 (described in detail below).

Figure 4:
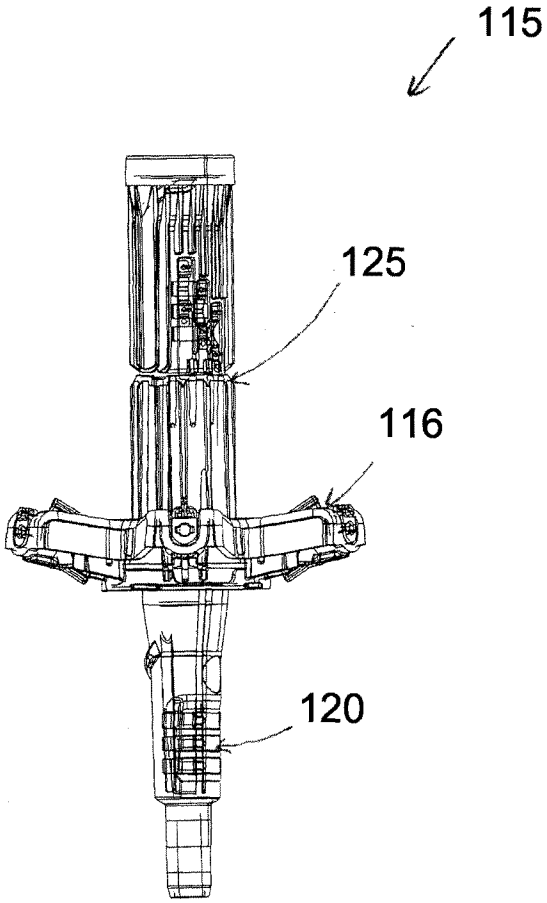
FIG. 4 is a front view of a branch ring in accordance with an embodiment.
Figure 5:
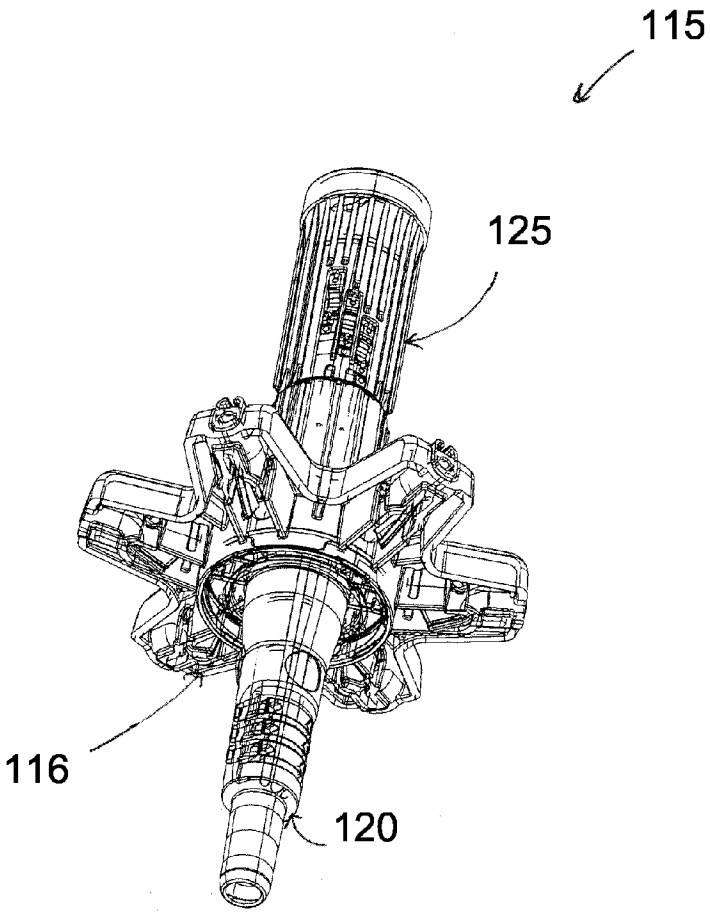
FIG. 5 is a bottom perspective view of a branch ring in accordance with an embodiment.
Figure 6:
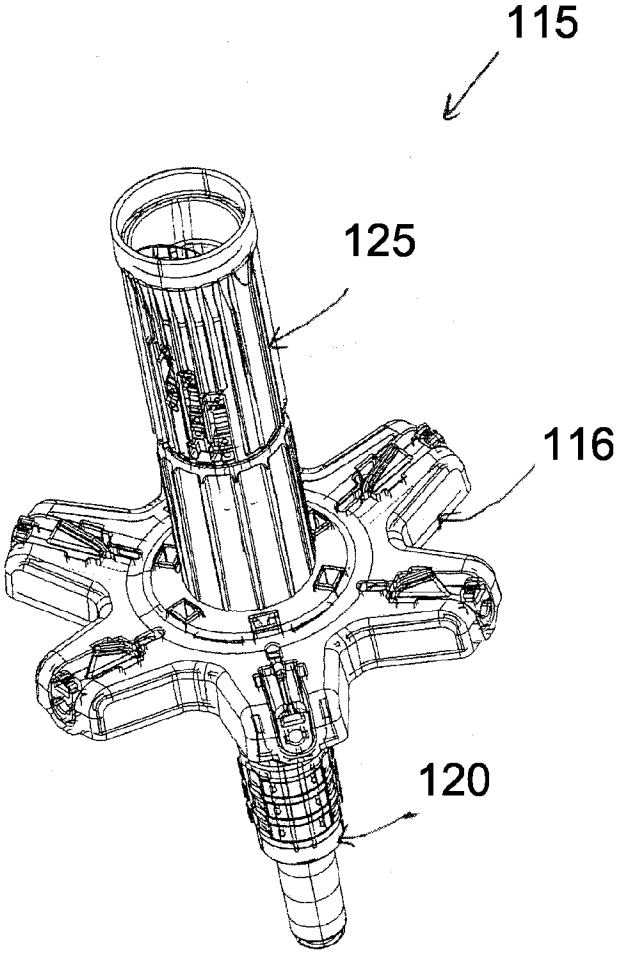
FIG. 6 is a top perspective view of a branch ring in accordance with an embodiment.
Figure 7:
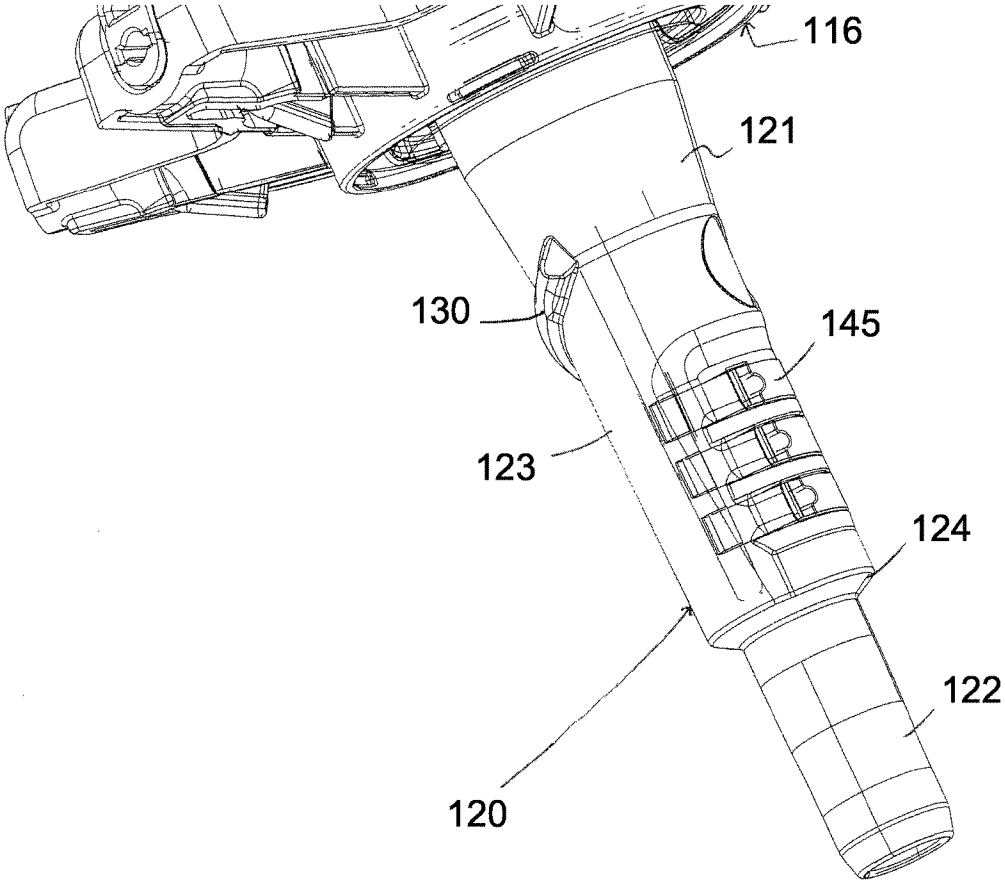
FIG. 7 is a front perspective view of a branch ring bottom end in accordance with an embodiment.
Figure 8:
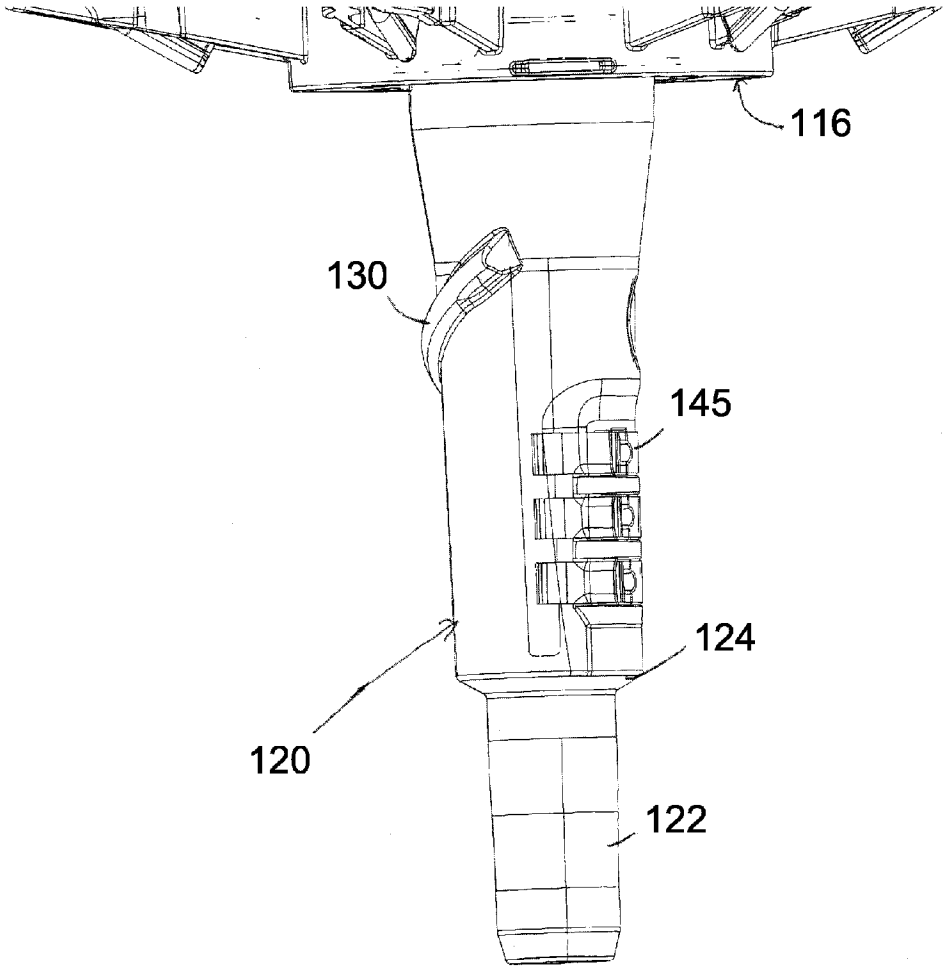
FIG. 8 is a front view of a branch ring bottom end in accordance with an embodiment.
Figure 9:
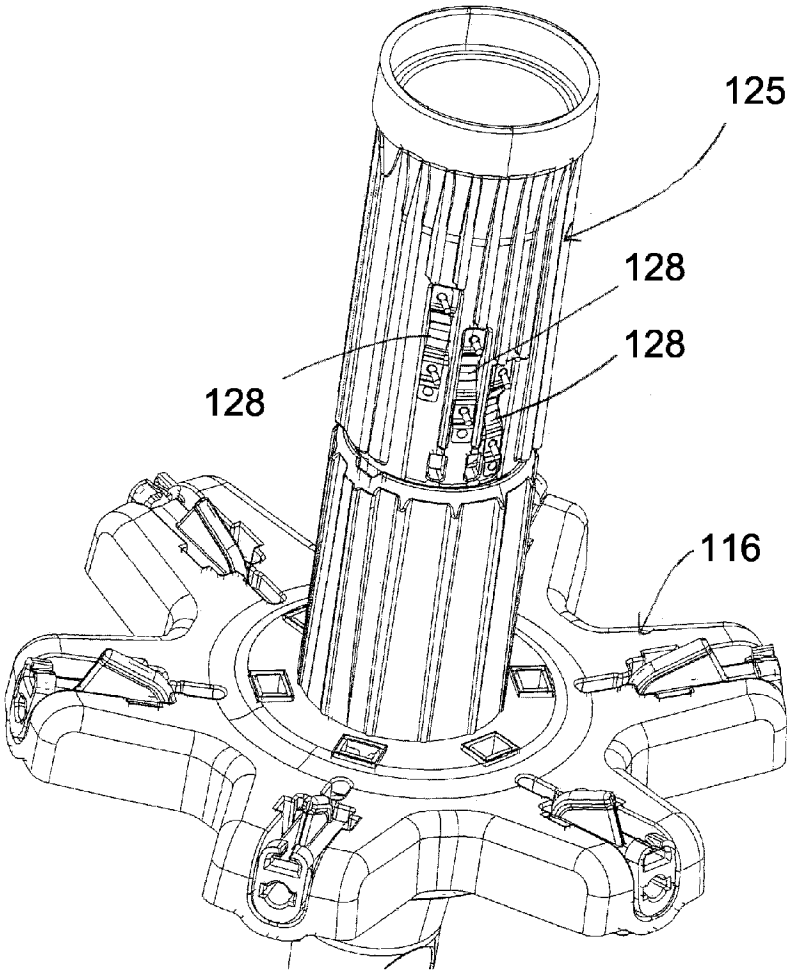
FIG. 9 is a front perspective view of a branch ring top end in accordance with an embodiment.
Figure 10:
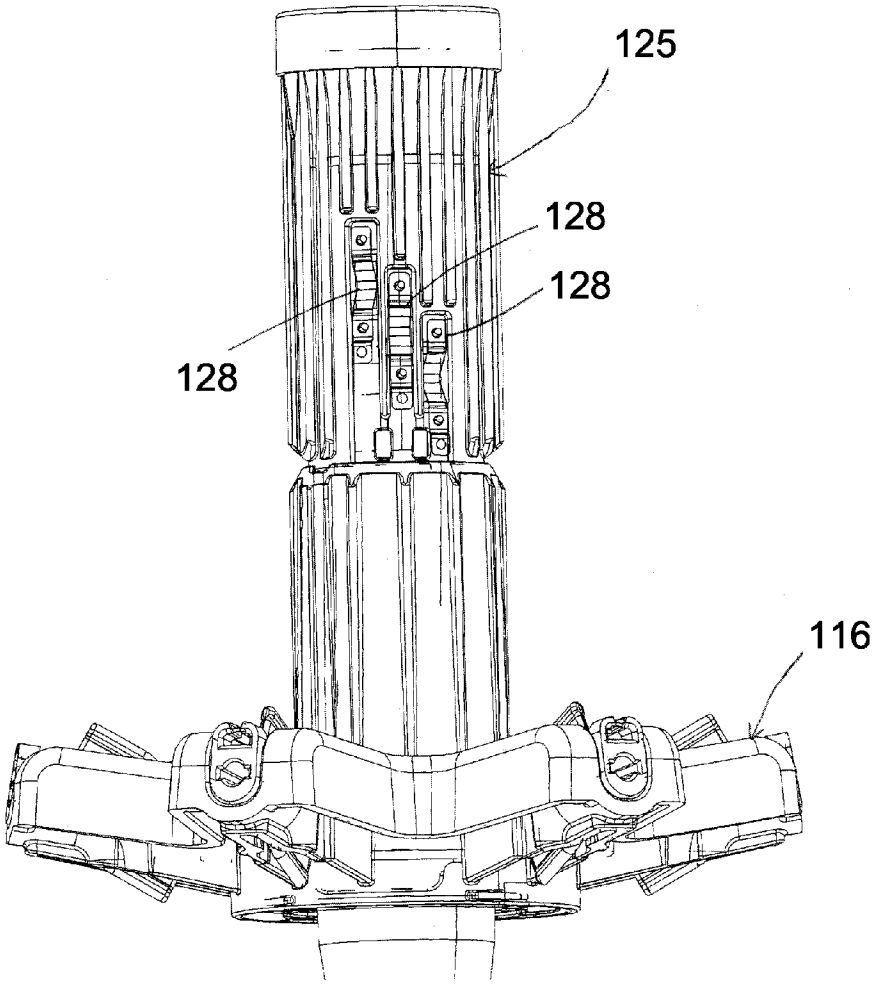
FIG. 10 is a front view of a branch ring top end in accordance with an embodiment.
Figure 11:
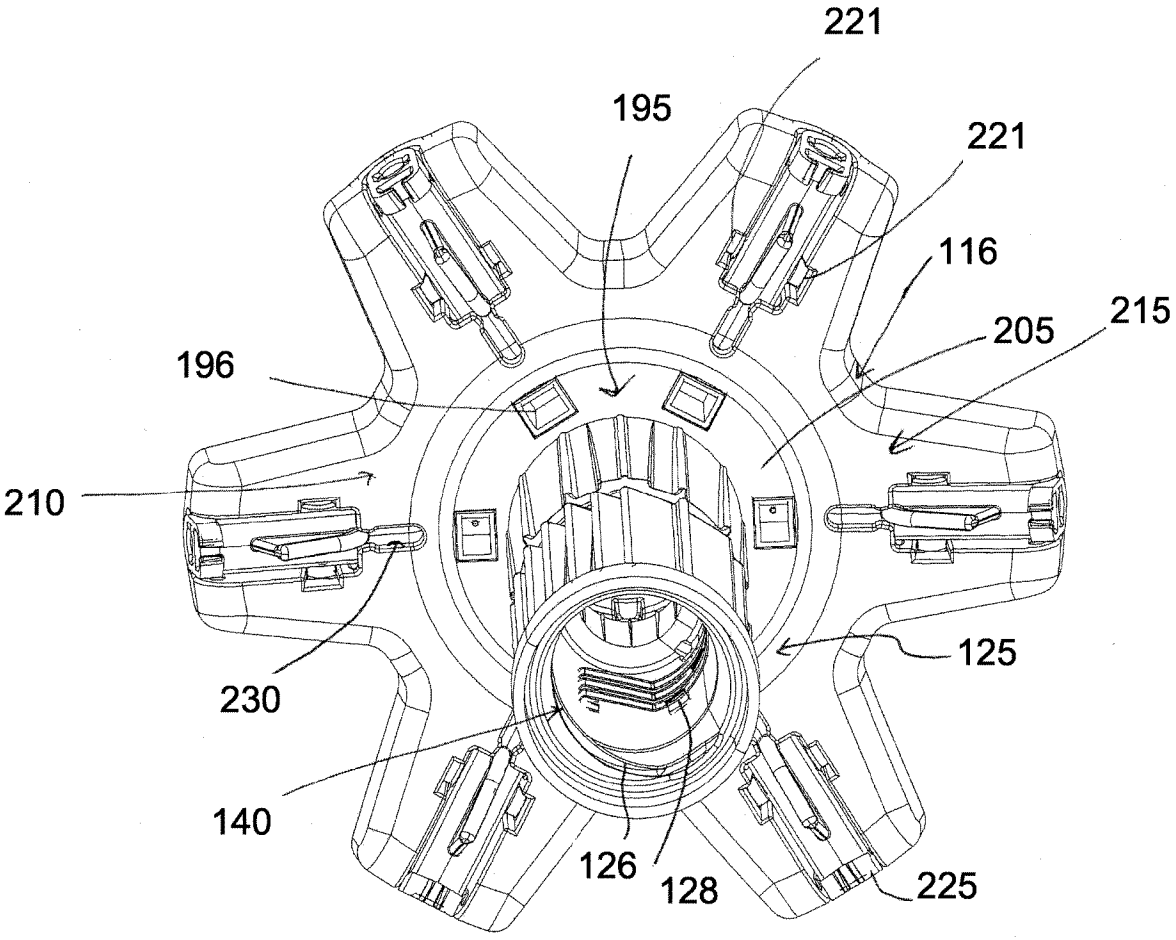
FIG. 11 is a top perspective view of a branch ring in accordance with an embodiment.

The center pole 55 includes a plurality of branch rings 115, as illustrated in FIGS. 4-6. Each of the branch rings 115 includes a center ring 116. A bottom end 120 extends from a bottom of the center ring 116, as illustrated in FIGS. 7-8. A top end 125 extends from a top of the center ring 116, as illustrated in FIG. 9-11. The plurality of branch rings 115 is configured to couple on top of each other to form the center pole 55. In one embodiment, any number of branch rings 115 may be coupled to adjust the height of the center pole 55. In the illustrated embodiment, the top end 125 is configured as a female portion of the branch ring 115 and the bottom end 120 is configured as a male portion of the branch ring 115. In an alternative embodiment, the top end 125 may be configured as a male portion of the branch ring 115 and the bottom end 120 may be configured as a female portion of the branch ring 115. The lowermost branch ring 115 is received in the stand, and the uppermost branch ring 115 receives the topper 155, as described in more detail below.

In at least one embodiment, the bottom end 120 includes an upper shoulder 121 that tapers downward from the center ring 116. A substantially cylindrical midsection 123 extends from the upper shoulder 121. Additionally, a root 122 extends from the midsection 123 such that a lower shoulder 124 is defined between the root 122 and the midsection 123. In one embodiment, the upper shoulder 121, the midsection 123, the lower shoulder 124 and the root 122 provide stability to the assembly 50 when the branch rings 115 are coupled together. The bottom end 120 includes a bottom end thread 130. In at least one embodiment, the bottom end thread 130 is positioned on an outer surface of the bottom end 120. In at least one embodiment, the bottom end thread 130 extends from the upper shoulder 121 to the midsection 123. The bottom end 120 also includes a plurality of bottom end electrical contacts 145. In one embodiment, the bottom end electrical contacts 145 are positioned on the outer surface of the midsection 123.

The top end 125 includes a top end thread 126, shown in FIG. 11. In at least one embodiment, the top end 125 includes a hollow opening 140, shown in FIG. 11. In at least one embodiment, the top end thread 126 is positioned along an internal surface of the top end 125 within the hollow opening 140. The top end 125 also includes a plurality of top end electrical contacts 128. In at least one embodiment, the plurality of top end electrical contacts 128 is positioned along the inner surface of the hollow opening 140 formed in the branch ring top end 125. The plurality of bottom end electrical contacts 145 and the plurality of top end electrical contacts 128 of each branch ring 115 are in electrical communication. For example, wiring may extend through the branch ring 115 from the plurality of top end electrical contacts 128 to the plurality of bottom end electrical contacts 145. In one embodiment, the wiring may be molded into the branch ring 115.

Figure 12:
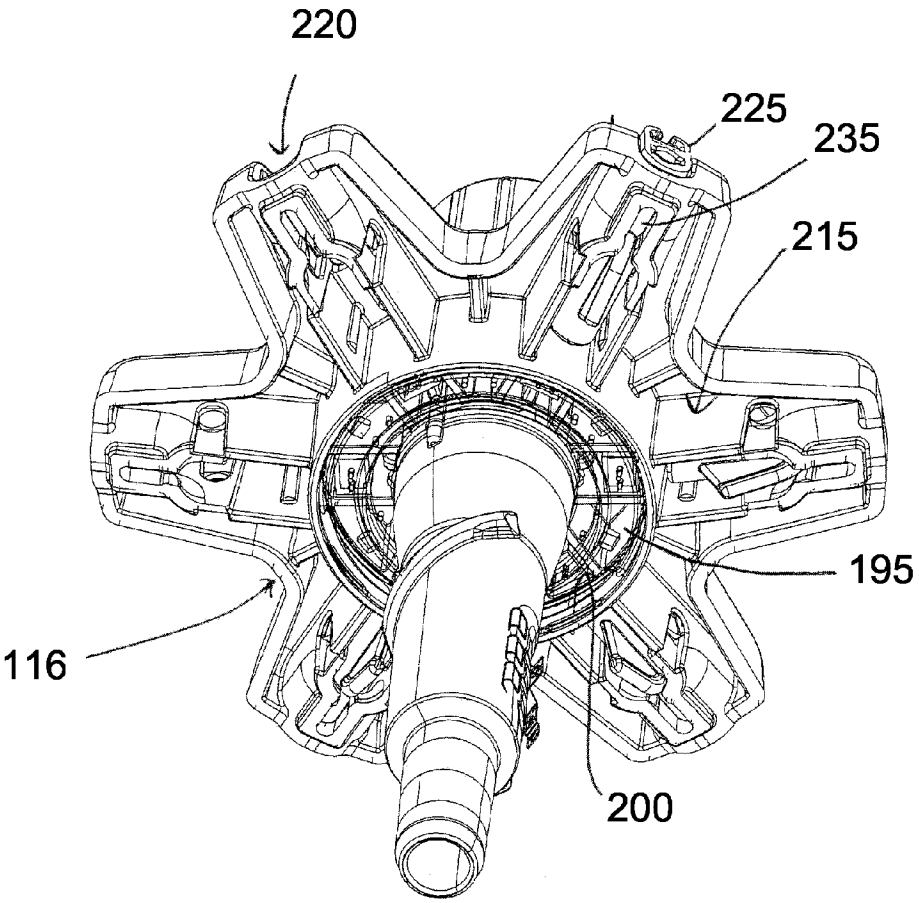
FIG. 12 is a bottom perspective view of a branch ring in accordance with an embodiment.
Figure 14:
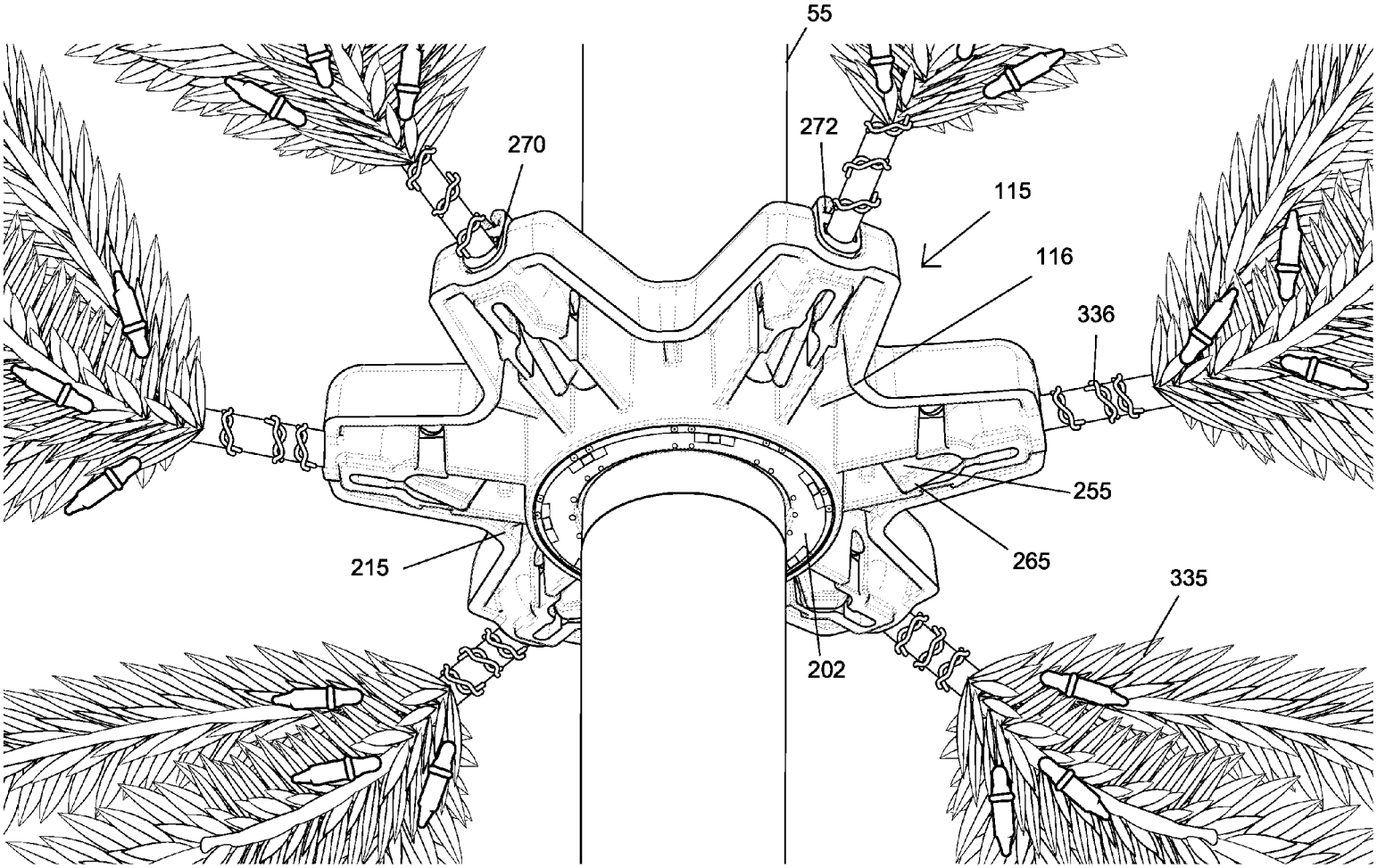
FIG. 14 is a bottom perspective view of a branch ring having branch assemblies coupled thereto in accordance with an embodiment.
Figure 15:
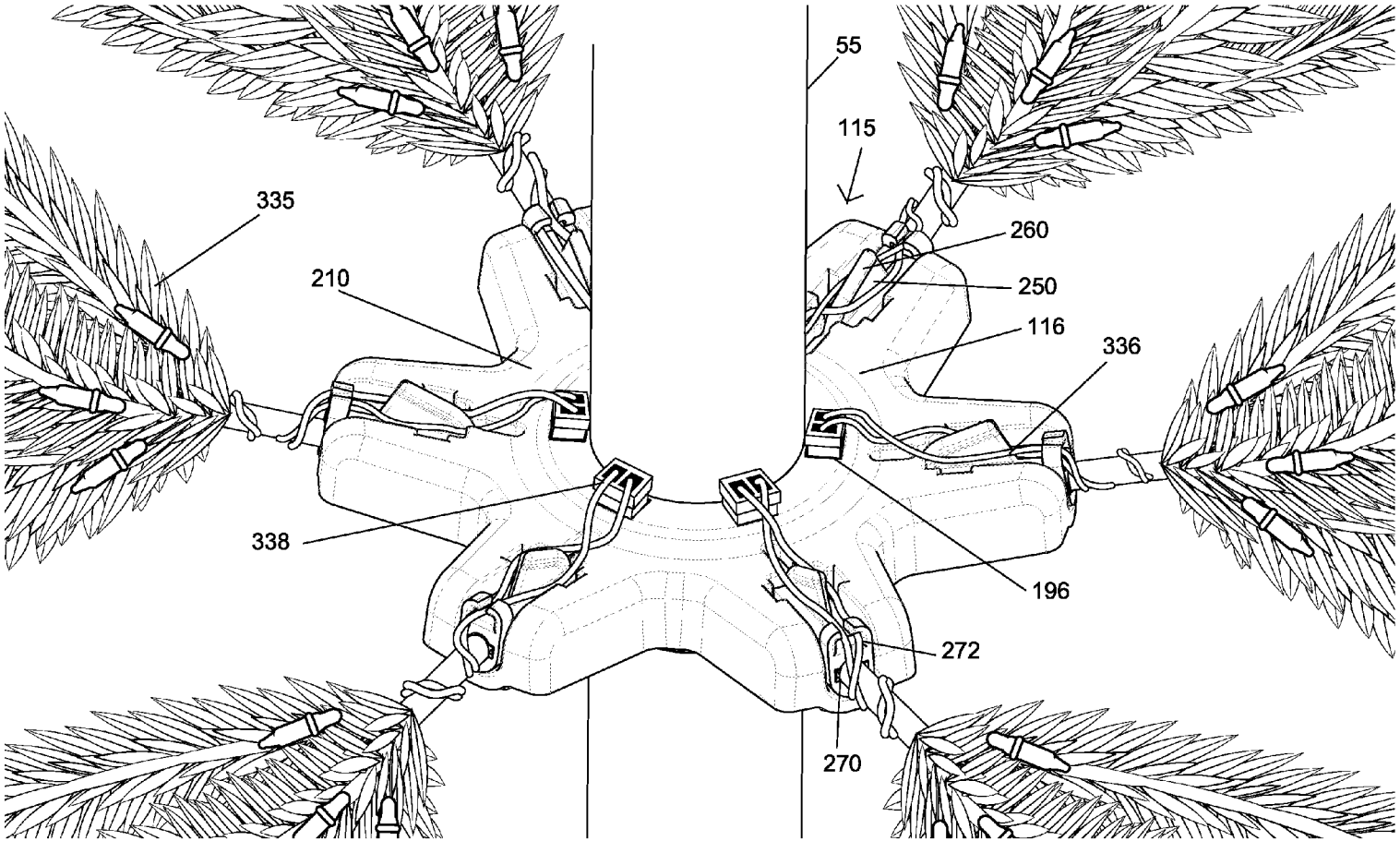
FIG. 15 is a top perspective view of a branch ring having branch assemblies coupled thereto in accordance with an embodiment.

In at least one embodiment, shown in FIGS. 11-12, the center ring 116 of each branch ring 115 may include a circuit board that is electrically coupled to each of the plurality of top end electrical contacts 128 and the plurality of bottom end electrical contacts 145. The center ring 116 may include a light ring 195. The light ring 195 may include a bottom surface 200 having a plurality of downward facing lights 202 (shown in FIG. 14), and a top surface 205 having a plurality of upward facing lights (not shown). In at least one embodiment, the downward facing lights and upward facing lights may include light emitting diodes.

Figure 13:
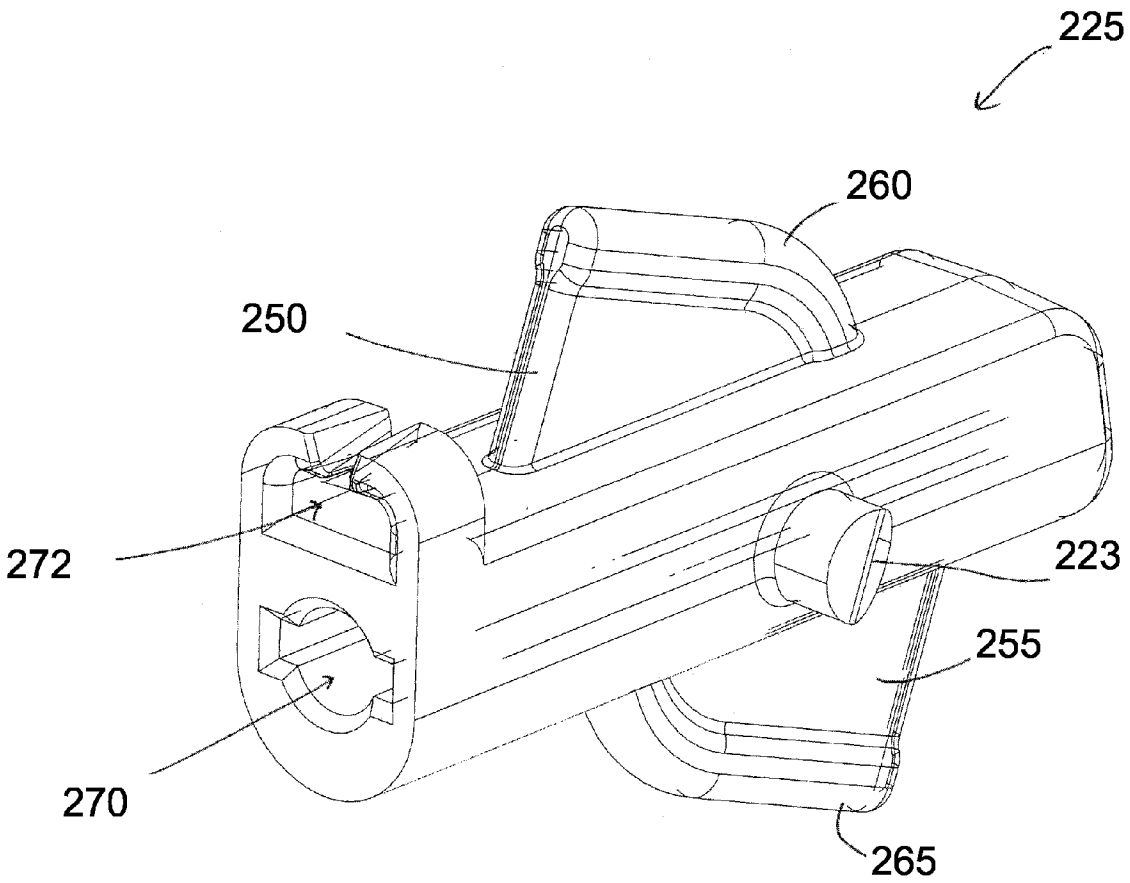
FIG. 13 is a side perspective view of a tree branch base in accordance with an embodiment.

In at least one embodiment, the center ring 116 of each branch ring 115 includes an upper side 210 and lower side 215, as illustrated in FIGS. 11-12 and 14-15. At least one electrical connector 196 is positioned within the center ring 116 and has an input end facing the upper side 210. Each branch ring 115 also includes a plurality of nests 220. A pair of slots 221 is formed in each nest 220. Each nest 220 includes a tree branch base 225 (illustrated in FIG. 13) having a pair of pins 223 that are received in the slots 221 to rotatably couple the tree branch base 225 to the nest 220. In at least one embodiment, the tree branch bases 225 are constructed and arranged to receive a branch assembly 335 (shown in FIGS. 14-15). A receptacle 270 is provided at an end of the tree branch base 225. The tree branch base 225 is configured to rotate within the nest 220 to articulate the artificial tree between a display position and a storage position. The nest 220 includes an upper slot 230 and a lower slot 235. The tree branch base 225 includes an upper wing 250 and a lower wing 255. The upper wing 250 includes an upper flange 260, and the lower wing 255 includes a lower flange 265. The upper flange 260 and the lower flange 265 move freely with the upper slot 230 and the lower slot 235, respectively. When the tree branch base 225 is articulated toward a storage position, the tree branch base 225 is rotated upward so that the upper flange 260 is moved in the upper slot 230, and the lower flange 265 is moved within the lower slot 235. When the tree branch base 225 is rotated upward, the respective tree branch assembly 335 is likewise rotated upward, so that the branch ring 115 may be stored with the tree branch assemblies 335 coupled thereto. In one embodiment, the flanges 260 and 265 frictionally engage the slots 230 and 235 so that the friction holds the tree branch base 225 in position until manually moved by a user. For example, the tree branch base 225 may be frictionally held in the storage position or in any intermediate position between the storage position and the operational position.

Each tree branch assembly 335 may be coupled to a respective tree branch base 225, which is coupled to a branch ring 115 during manufacturing. Each tree branch assembly 335 includes a strand of lights 336 couple thereto. In one embodiment, the strand of lights 336 is held in position by a slot 272 in the tree branch base 225 and electrically coupled to the corresponding electrical connector 196 of the branch ring 115 via a plug 338. Because the strand of lights 336 is individually strung to each tree branch assembly 335, the strand of lights 336 may be replaced individually. For example, if the strand of lights 336 on one tree branch assembly 335 fails, that strand of lights 336 may be disconnected from the respective electrical connector 196 and individually replaced without replacing each strand of lights 336 on the artificial evergreen tree 50.

In at least one embodiment, the bottom end 120 of a branch ring 115 is configured to be received in the stand 70. It should be noted that any branch ring 115 may be inserted into the stand 70; however, for aesthetic purposes, the branch rings 115 may be coupled in a particular order. Additionally, the branch rings 115 may be coupled in any configuration desirable by the user. In one embodiment, the user may couple only some of the branch rings 115 to adjust a height of the assembly 50. The bottom end thread 130 of the lowermost branch ring 115 may engage the thread 330 of the stand 70. In at least one embodiment, the bottom end 120 of the lowermost branch ring 115 may be inserted into the upper post 290 of the stand 70. When the center post 285 of the stand 70 is coupled to the bottom end 120 of the lowermost branch ring 115, an electrical connection is made between the center post 285 of the stand 70 and the bottom end 120 of the lowermost branch ring 115. For example, the plurality of bottom end electrical contacts 145 of the lowermost branch ring 115 may align with and electrically engage the plurality of electrical connections 325 of the stand 70. Accordingly, upon assembly, the stand 70 is electrically coupled to the lowermost branch ring 115. In at least one embodiment, the stand 70 includes an electrical cord to plug into an electrical outlet.

Each of the branch ring assemblies 115 is then coupled on one another starting with the lowermost branch ring 115. A first branch ring 115 is configured to receive a second branch ring 115. In one embodiment, when first and second branch rings 115 are secured together, the tree branch assemblies 335 of the first branch ring 115 are offset from the tree branch assemblies 335 of the second branch ring 115. The bottom end thread 130 of the second branch ring is received by the top end thread 126 of the first branch ring 115. In at least one embodiment, the bottom end 120 of the second branch ring 115 is received in the top end 125 of the first branch ring 115 and screwed therein via the bottom end thread 130 and the top end thread 126. In one embodiment, the bottom end 120 of the second branch ring 115 may be received in the top end 125 of the first branch ring 115 with limited human intervention and through the force of gravity. The bottom end 120 of the second branch ring 115 is configured to be received in the top end 125 of the first branch ring 115 so that the plurality of bottom end electrical contacts 145 of the second branch ring 115 and the plurality of top end electrical contacts 128 of the first branch ring 115 are coupled in electrical communication. The upper shoulder 121, the midsection 123, the lower shoulder 124 and the root 122 of the second branch ring 115 substantially match an inner contour of the top end 125 of the first branch ring 115 to stabilize the second branch ring 115 within the first branch ring 115 to stabilize the entire center pole 55 of the artificial evergreen tree 50 when the plurality of branch rings 115 are coupled together to the form the center pole 55. In one embodiment, a material of the branch ring 115 may also facilitate stabilizing and strengthening the artificial evergreen tree 50. For example, the branch ring 115 may be formed from glass filled polypropylene. In one embodiment, the interaction of threads 126 and 130 also facilitate stabilizing and strengthening the artificial evergreen tree 50.

Figure 16:
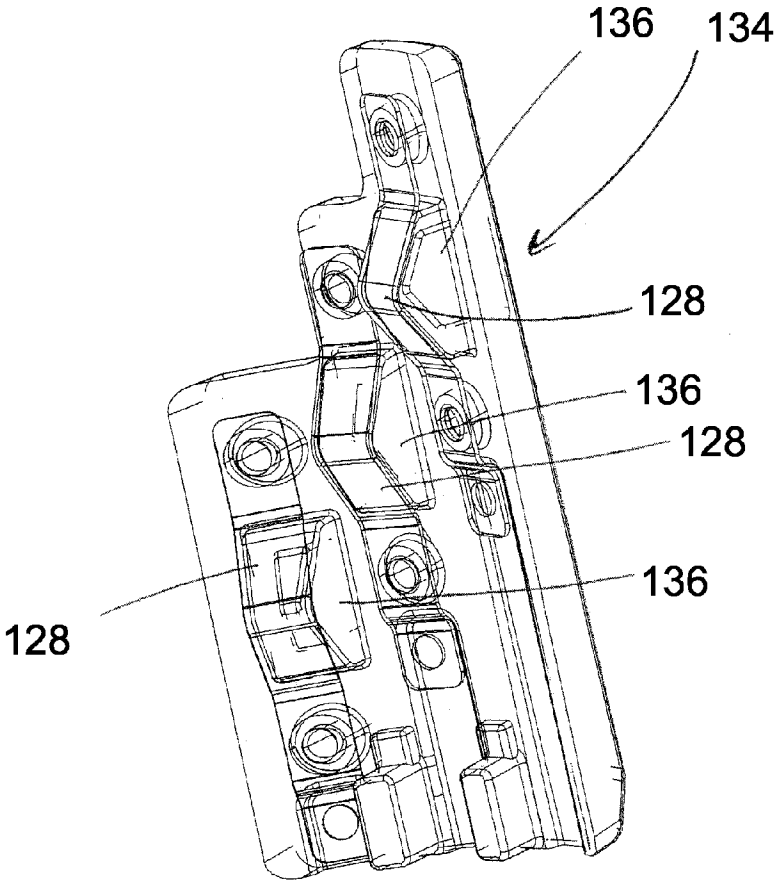
FIG. 16 is a side perspective view of an insulator in accordance with an embodiment.

An insulator 134, shown in FIG. 16, may be formed from rubber or any other suitable insulating material. In at least one embodiment, the insulator 134 may cover and insulate the plurality of top end electrical contacts 125 to prevent or reduce a risk of electrical shock. The insulator 134 may include a protrusion 136 that biases the plurality of top end electrical contacts 125 of the first branch ring 115 toward the plurality of bottom end electrical contacts 145 of the second branch ring 115. In one embodiment, the insulator 134 also improves the sturdiness of the assembly 50 by securing the second branch ring 115 within the first branch ring 115.

Figure 17:
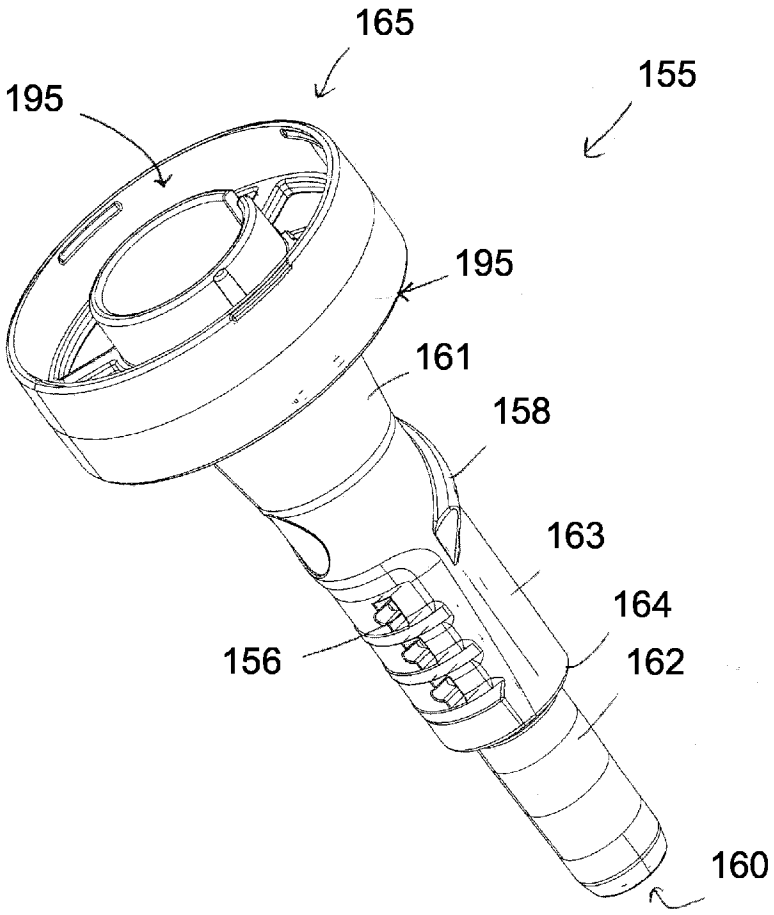
FIG. 17 is a front perspective view of a topper in accordance with an embodiment.

After all of the branch rings 115 are coupled to form the center pole, the topper 155, shown in FIG. 17, may be coupled to the uppermost branch ring 115. The topper 155 includes a bottom end 160 and a top end 165. In at least one embodiment, the bottom end 160 includes an upper shoulder 161 that tapers downward from the top end 165. A substantially cylindrical midsection 163 extends from the upper shoulder 161. Additionally, a root 162 extends from the midsection 163 such that a lower shoulder 164 is defined between the root 162 and the midsection 163. In one embodiment, the upper shoulder 161, the midsection 163, the lower shoulder 164 and the root 162 provide stability to the topper 155 when the topper 155 is coupled to a branch ring 115. In at least one embodiment, the bottom end 160 may include a plurality of topper electrical contacts 156 and a thread 158. The bottom end 160 may be received in the top end 125 of the uppermost branch ring 115 to couple the topper 155 and the uppermost branch ring 115. In at least one embodiment, the topper 155 is coupled to the uppermost branch ring 115 and screwed therein. In one embodiment, the topper 155 is coupled to the uppermost branch ring 115 with limited human intervention and through the force of gravity. When the topper 155 is coupled to the uppermost branch ring 115, the plurality of topper electrical contacts 156 and the plurality of top end electrical contacts 128 of the uppermost branch ring 115 are aligned establishing electrical continuity between the topper 155 and the uppermost branch ring 115.

In at least one embodiment, the topper 155 includes a light ring 195 having a circuit board. The light ring 195 may include a plurality of downward facing lights (not shown), and a plurality of upward facing lights (not shown). In at least one embodiment, the downward facing lights and upward facing lights may include light emitting diodes.

Figure 18:
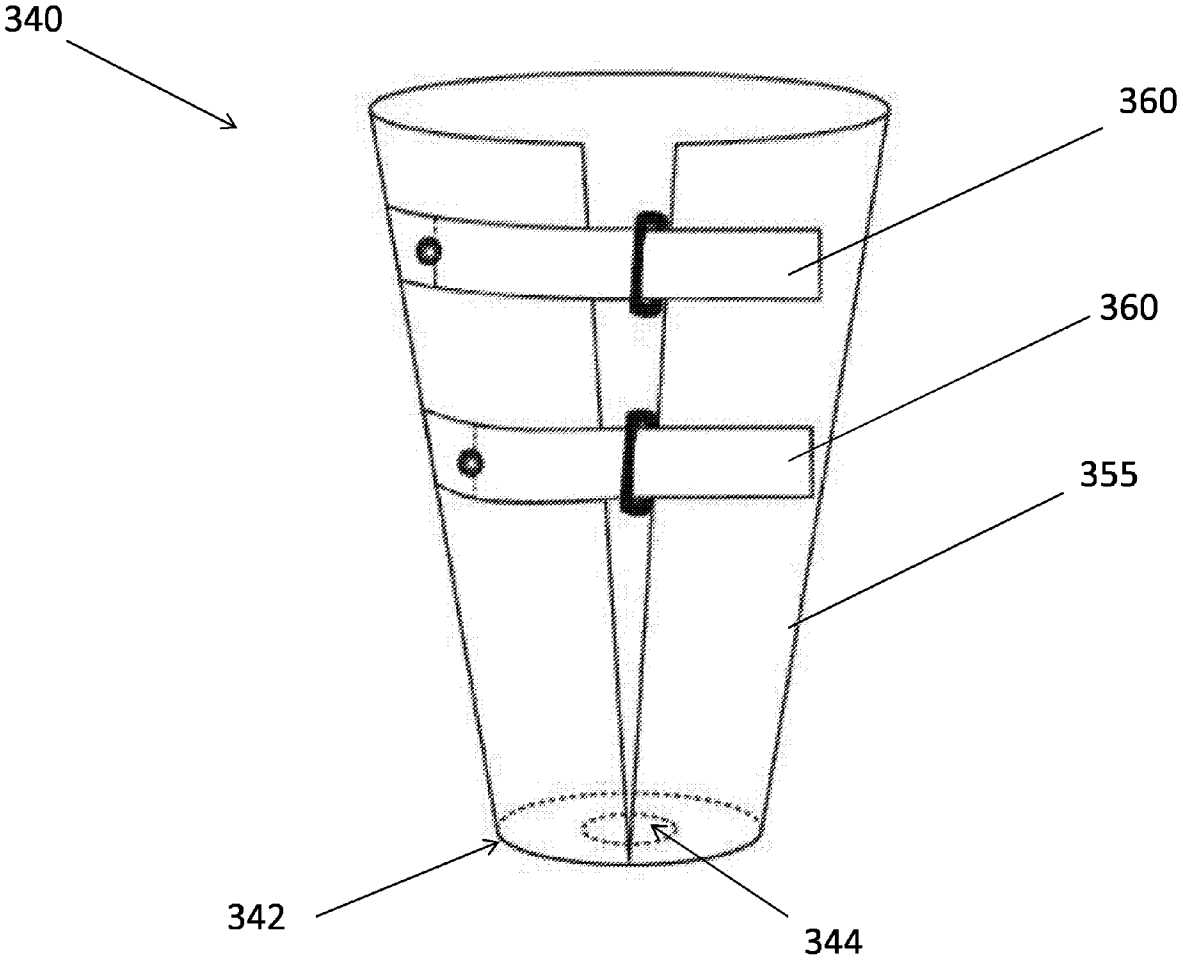
FIG. 18 is a schematic view of a storage wrap for a branch ring having branch assemblies thereon in accordance with an embodiment.

FIG. 18 is a schematic view of a storage wrap 340 for a branch ring 115 having branch assemblies 335 thereon in accordance with an embodiment. The storage wrap 340 may include a non-woven material 355 having straps 360 positioned thereon. In at least one embodiment, the storage wrap 340 may be formed from plastic, fabric, or any other suitable material. The storage wrap 340 may include a hub 342 having an opening 344 therethrough to receive the bottom end 120 of the branch ring 115. The material 355 is wrapped around the branch assembly 335 and secured with the strap 360. The strap 360 may be secured via hook and loop fasteners, buckles, or the like. As the strap 360 is tightened the branch assembly 335 is compacted together to reduce a size of the branch assembly 335. In at least one embodiment, the artificial evergreen tree is sold with storage wraps 340 of various sizes that correspond to a size of the branch assembly 335 of each branch ring 115. In at least one embodiment, any number of storage wrap sizes may be provided. Because the branch rings 115 having branch assemblies 335 thereon are compacted in size when wrapped in the storage wrap 340, the wrapped branch assemblies 335 become sized to fit within the storage box, thereby overcoming issues with prior art artificial trees that do not fit back into a box after having been removed therefrom.

While this disclosure has been described as having preferred designs, the apparatus and methods according to the present disclosure can be further modified within the scope and spirit of this disclosure. This application is therefore intended to cover any variations, uses, or adaptations of the disclosure using its general principles. For example, any method disclosed herein and in the appended claims represent one possible sequence of performing the steps thereof. A practitioner may determine in a particular implementation that a plurality of steps of one or more of the disclosed methods may be combinable, or that a different sequence of steps may be employed to accomplish the same results. Each such implementation falls within the scope of the present disclosure as disclosed herein and in the appended claims. Furthermore, this application is intended to cover such departures from the present disclosure as come within known or customary practice in the art to which this disclosure pertains.

We claim:

1. An artificial evergreen tree comprising:

a first branch ring comprising:

a plurality of first nests;

a plurality of first tree branch bases, each of the plurality of first tree branch bases being rotatably coupled to a respective one of the plurality of first nests and having one of a plurality of first branch assemblies coupled thereto;

a first bottom segment comprising an upper end and a lower end, the upper end proximal to the plurality of first nests and the lower end distal to the plurality of first nests, the first bottom segment further comprising a first bottom segment exterior surface between the upper end and the lower end, and a first bottom segment electrical contact, the first bottom segment electrical contact positioned on the first bottom segment exterior surface; and a first top segment comprising an upper end and a lower end, the upper end being open to a hollow interior having a first top segment interior surface, the upper end distal to the plurality of first nests and the lower end proximal to the plurality of first nests, the first top segment further comprising a first top segment electrical contact positioned on the first top segment interior surface, the first top segment electrical contact being in electrical communication with the first bottom segment electrical contact, wherein the plurality of first nests is positioned between the first bottom segment and the first top segment; and a second branch ring comprising:

a plurality of second nests;

a plurality of second tree branch bases, each of the plurality of second tree branch bases being rotatably coupled to a respective one of the plurality of second nests and having one of a plurality of second branch assemblies coupled thereto;

a second bottom segment comprising an upper end and a lower end, the upper end proximal to the plurality of second nests and the lower end distal to the plurality of second nests, the second bottom segment further comprising a second bottom segment exterior surface between the upper end and the lower end, and a second bottom segment electrical contact, the second bottom segment electrical contact positioned on the second bottom segment exterior surface; and a second top segment comprising an upper end and a lower end, the upper end being open to a hollow interior having a second top segment interior surface, the upper end distal to the plurality of second nests and the lower end proximal to the plurality of second nests, the second top segment further comprising a second top segment electrical contact positioned on the second top segment interior surface, the second top segment electrical contact being in electrical communication with the second bottom segment electrical contact, wherein the plurality of second nests is positioned between the second bottom segment and the second top segment;

wherein the first top segment of the first branch ring is configured to receive the second bottom segment of the second branch ring through the open upper end of the first top segment and into the hollow interior of the first top segment, so that the first top segment electrical contact of the first branch ring is aligned with and in electrical communication with the second bottom segment electrical contact of the second branch ring.

2. The artificial evergreen tree of claim 1, wherein each of the plurality of first branch assemblies and the plurality of second branch assemblies comprises at least one light that is electrically coupled to the respective first branch ring or second branch ring.

3. The artificial evergreen tree of claim 2, wherein the at least one light of one of the plurality of first branch assemblies and the plurality of second branch assemblies is replaceable without replacing the at least one light of another of the plurality of first branch assemblies and the plurality of second branch assemblies.

4. The artificial evergreen tree of claim 1 further comprising an insulator positioned over the first top segment electrical contact of the first branch ring.

5. The artificial evergreen tree of claim 1, wherein the second bottom segment comprises a root defining a shoulder, wherein the root and the shoulder stabilize the artificial evergreen tree when the first top segment of the first branch ring is coupled to the second bottom segment of the second branch ring.

6. The artificial evergreen tree of claim 1, wherein each of the first branch ring and the second branch ring further comprises a structurally integrated light ring having at least one of upward facing and downward facing lights, the light ring electrically coupled to the respective first top segment electrical contact and first bottom segment electrical contact or second top segment electrical contact and second bottom segment electrical contact.

7. The artificial evergreen tree of claim 1 further comprising a topper that is received in the second top segment of the second branch ring so that the topper electrically couples to the second branch ring.

8. The artificial evergreen tree of claim 1 further comprising a stand to receive the first bottom segment of the second branch ring.

9. The artificial evergreen tree of claim 8, wherein any number of first branch rings and second branch rings may be coupled to the stand.

10. The artificial evergreen tree of claim 8, wherein the stand is electrically coupled to the first branch ring and the second branch ring.

11. An artificial evergreen tree comprising:

a first branch ring comprising:

a plurality of first nests;

a plurality of first tree branch bases, each of the plurality of first tree branch bases being rotatably coupled to a respective one of the plurality of first nests and having one of a plurality of first branch assemblies coupled thereto;

a first bottom segment comprising an upper end and a lower end and an axial length between the upper end and the lower end, the upper end proximal to the plurality of first nests and the lower end distal to the plurality of first nests, the first bottom segment further comprising a first bottom segment exterior surface between the upper end and the lower end, and a first bottom segment thread on the first bottom segment exterior surface, the first bottom segment thread extending along a portion of the axial length of the first bottom segment but completing less than one revolution around the first bottom segment; and a first top segment comprising an upper end and a lower end, the upper end being open to a hollow interior having a first top segment interior surface, the upper end distal to the plurality of first nests and the lower end proximal to the plurality of first nests, the first top segment further comprising a first top segment thread on the first top segment interior surface, wherein the plurality of first nests is positioned between the first bottom segment and the first top segment; and a second branch ring comprising:

a plurality of second nests;

a plurality of second tree branch bases, each of the plurality of second tree branch bases being rotatably coupled to a respective one of the plurality of second nests and having one of a plurality of second branch assemblies coupled thereto;

a second bottom segment comprising an upper end and a lower end and an axial length between the upper end and the lower end, the upper end proximal to the plurality of second nests and the lower end distal to the plurality of second nests, the second bottom segment further comprising a second bottom segment exterior surface between the upper end and the lower end, and a second bottom segment thread on the second bottom segment exterior surface, the second bottom segment thread extending along a portion of the axial length of the second bottom segment but completing less than one revolution around the second bottom segment; and a second top segment comprising an upper end and a lower end, the upper end being open to a hollow interior having a second top segment interior surface, the upper end distal to the plurality of second nests and the lower end proximal to the plurality of second nests, the second top segment further comprising a second top segment thread on the second top segment interior surface, wherein the plurality of second nests is positioned between the second bottom segment and the second top segment;

wherein the first top segment of the first branch ring is configured to couple to the second bottom segment of the second branch ring so that the first top segment thread of the first branch ring and the second bottom segment thread of the second branch ring are coupled.

12. The artificial evergreen tree of claim 11, wherein the first top segment thread of the first branch ring and the second bottom segment thread of the second branch ring stabilize the artificial evergreen tree when the first top segment of the first branch ring is coupled to the second bottom segment of the second branch ring.

13. The artificial evergreen tree of claim 11, wherein the second bottom segment comprises a root defining a shoulder, wherein the root and the shoulder stabilize the artificial evergreen tree when the first top segment of the first branch ring is coupled to the second bottom segment of the second branch ring.

14. The artificial evergreen tree of claim 11, wherein the first branch ring and the second branch ring are electrically coupled when the first top segment of the first branch ring is coupled to the second bottom segment of the second branch ring.

15. The artificial evergreen tree of claim 14, wherein each of the first branch ring and the second branch ring further comprises a structurally integrated light ring having at least one of upward facing and downward facing lights.

16. The artificial evergreen tree of claim 14, wherein each of the plurality of first branch assemblies and the plurality of second branch assemblies comprises at least one light that is electrically coupled to the respective first branch ring or second branch ring.

17. The artificial evergreen tree of claim 16, wherein the at least one light of one of the plurality of first branch assemblies and the plurality of second branch assemblies is replaceable without replacing the at least one light of another of the plurality of first branch assemblies and the plurality of second branch assemblies.

18. The artificial evergreen tree of claim 11 further comprising a stand to receive the first bottom segment of the second branch ring.

19. The artificial evergreen tree of claim 18, wherein any number of first branch rings and second branch rings may be coupled to the stand.

20. The artificial evergreen tree of claim 18, wherein the stand is electrically coupled to the first branch ring and the second branch ring.

21. An artificial evergreen tree comprising:

a first branch ring comprising:

a plurality of first nests;

a plurality of first tree branch bases, each of the plurality of first tree branch bases being rotatably coupled to a respective one of the plurality of first nests and having one of a plurality of first branch assemblies coupled thereto, at least one of the plurality of first tree branch bases comprising an integrated light ring having at least one of upward facing and downward facing lights;

a first bottom segment comprising an upper end and a lower end and an axial length between the upper end and the lower end, the upper end proximal to the plurality of first nests and the lower end distal to the plurality of first nests, the first bottom segment further comprising a first bottom segment exterior surface between the upper end and the lower end, a first bottom segment electrical contact on the first bottom segment exterior surface, and a first bottom segment thread on the first bottom segment exterior surface, the first bottom segment thread extending along a portion of the axial length of the first bottom segment but completing less than one revolution around the first bottom segment; and a first top segment comprising an upper end and a lower end, the upper end being open to a hollow interior having a first top segment interior surface, the upper end distal to the plurality of first nests and the lower end proximal to the plurality of first nests, the first top segment further comprising a first top segment thread on the first top segment interior surface and a first top segment electrical contact on the first top segment interior surface, the first top segment electrical contact being in electrical communication with the first bottom segment electrical contact, wherein the plurality of first nests is positioned between the first bottom segment and the first top segment; and a second branch ring comprising:

a plurality of second nests;

a plurality of second tree branch bases, each of the plurality of second tree branch bases being rotatably coupled to a respective one of the plurality of second nests and having one of a plurality of second branch assemblies coupled thereto, at least one of the plurality of second tree branch bases comprising an integrated light ring having at least one of upward facing and downward facing lights;

a second bottom segment comprising an upper end and a lower end and an axial length between the upper end and the lower end, the upper end proximal to the plurality of second nests and the lower end distal to the plurality of second nests, the second bottom segment further comprising a second bottom segment exterior surface between the upper end and the lower end, a second bottom segment electrical contact on the second bottom segment exterior surface, and a second bottom segment thread on the second bottom segment exterior surface, the second bottom segment thread extending along a portion of the axial length of the second bottom segment but completing less than one revolution around the second bottom segment; and a second top segment comprising an upper end and a lower end, the upper end being open to a hollow interior having a second top segment interior surface, the upper end distal to the plurality of second nests and the lower end proximal to the plurality of second nests, the second top segment further comprising a second top segment thread on the second top segment interior surface and a second top segment electrical contact on the second top segment interior surface, the second top segment electrical contact being in electrical communication with the second bottom segment electrical contact, wherein the plurality of second nests is positioned between the second bottom segment and the second top segment; and wherein the first top segment of the first branch ring is configured to receive the second bottom segment of the second branch ring through the open upper end of the first top segment and into the hollow interior of the first top segment, so that the first top segment thread of the first branch ring and the second bottom segment thread of the second branch ring are coupled and the first top segment electrical contact of the first branch ring is aligned with and in electrical communication with the second bottom segment electrical contact of the second branch ring.

* * * * *